US005188555A

United States Patent [19]

Zbegner

[11] Patent Number: 5,188,555

[45] Date of Patent: Feb. 23, 1993

[54] MAGNETIC NOVELTY

[76] Inventor: Joseph H. Zbegner, 1129 11th St., #6, Boulder, Colo. 80302

[21] Appl. No.: 817,055

[22] Filed: Jan. 6, 1992

[51] Int. Cl.[5] ..... A63H 33/26

[52] U.S. Cl. ..... 446/133; 446/129; 273/443

[58] Field of Search ..... 446/129, 131, 132, 133, 446/134, 135; 273/443, 448, 456

[56] References Cited

U.S. PATENT DOCUMENTS

| | | | |
|---|---|---|---|
| 1,859,764 | 5/1932 | Bougon . | |
| 2,961,796 | 11/1960 | Davis | 446/131 |
| 3,207,960 | 9/1965 | MacDougal | 446/129 X |
| 3,278,011 | 10/1966 | Viemeister | 446/129 X |
| 3,550,936 | 12/1970 | Puttick . | |
| 4,233,777 | 11/1980 | Inoue | 446/131 |
| 4,295,832 | 10/1981 | Karell | 273/456 X |
| 4,726,588 | 2/1988 | Caprio | 273/456 X |
| 4,938,728 | 7/1990 | Callari | 446/133 |

FOREIGN PATENT DOCUMENTS

| | | | |
|---|---|---|---|
| 865376 | 3/1971 | Canada | 446/133 |

*Primary Examiner*—Robert A. Hafer
*Assistant Examiner*—Sam Rimell
*Attorney, Agent, or Firm*—Harold A. Burdick

[57] ABSTRACT

A magnetic novelty item is disclosed for use as a plaything, toy, amusement, diversion, game piece, or instructional aid. The item includes an enclosed container having magnets secured at opposite ends thereof with opposite magnetic poles facing the interior of the container (north at one end and south at the other). At least one additional magnet is received in the container in such a way that its magnetic poles are always oriented toward like magnetic poles of the magnets at the ends of the container while yet remaining movable in the space between the ends.

19 Claims, 1 Drawing Sheet

9
41
23
37
13
15
11
29
35
39
21

41
37
25
23
27
19
13
11
33
29
31
9
17
25
21
27
35
39

23
43
47
15
11
29
45
21

MAGNETIC NOVELTY

FIELD OF THE INVENTION

This invention relates to toys, and, more particularly, relates to magnetic toys, amusements, games, diversions, instructional aids, and other like novelties utilizing magnets or magnetism.

BACKGROUND OF THE INVENTION

Magnetic toys and games have been long known to be entertaining as well as educational. This fascination with magnets in general has provided many with simple and yet seemingly endless hours of amusement. By providing uncomplicated but effective structuring elements, this age-old fascination can be made even more entertaining and useful as an educational aid.

SUMMARY OF THE INVENTION

This invention provides a magnetic novelty item in the nature of a toy, plaything, game piece, diversion, entertainment, amusement, or instructional aid which includes a container having magnetic units secured at the ends thereof and at least one magnetic unit movably disposed in the container so that magnetic poles of the movable magnetic unit (or units) face like magnetic poles of the secured magnetic units. The container is preferably tubular in shape and includes an elongated cavity, preferably visible through the container wall, the movable magnetic unit (or units) being slidably received in the cavity.

It is therefore an object of this invention to provide a magnetic novelty item.

It is another object of this invention to provide a magnetic plaything having uncomplicated elements for structuring play and observation of magnets.

It is another object of this invention to provide a magnetic novelty item having a container with first and second opposite ends, a first magnetic unit secured at the first end of the container, a second magnetic unit secured at the second end of the container, and a third magnetic unit having a north pole and a south pole and received in the container in such a way that the poles remain substantially oriented toward different ones of the first and second magnetic units while yet being movable between the ends of the container.

It is still another object of this invention to provide a magnetic toy including a container at least in part defining an elongated cavity, a first magnetic unit secured at a first position adjacent to the cavity of the container so that only one pole of the first magnetic unit has substantial influence within the cavity, a second magnetic unit secured at a second position adjacent to the cavity and spaced from the first position so that only a pole thereof of opposite polarity to the one pole of the first unit has substantial influence within the cavity, and a third magnetic unit having first and second poles of opposite polarity and being slidably received in the cavity of the container in such a way that the poles thereof remain substantially oriented toward different ones of the poles of the first and second magnetic units in a repelling relationship.

It is yet another object of this invention to provide a magnetic toy including a tubular container having a side wall at least in part defining an elongated cavity visible through the side wall, a first magnetic unit having a north magnetic pole and secured adjacent to the cavity so that the north pole faces into the cavity, a second magnetic unit having a south magnetic pole and secured adjacent to the cavity so that the south pole faces into the cavity, and a third magnetic unit having a north magnetic pole and a south magnetic pole and being slidably received in the cavity between the first and second magnetic units so that the north pole of the third magnetic unit faces the north pole of the first magnetic unit and the south pole of the third magnetic unit faces the south pole of the second magnetic unit.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figures 1, 2, 3:
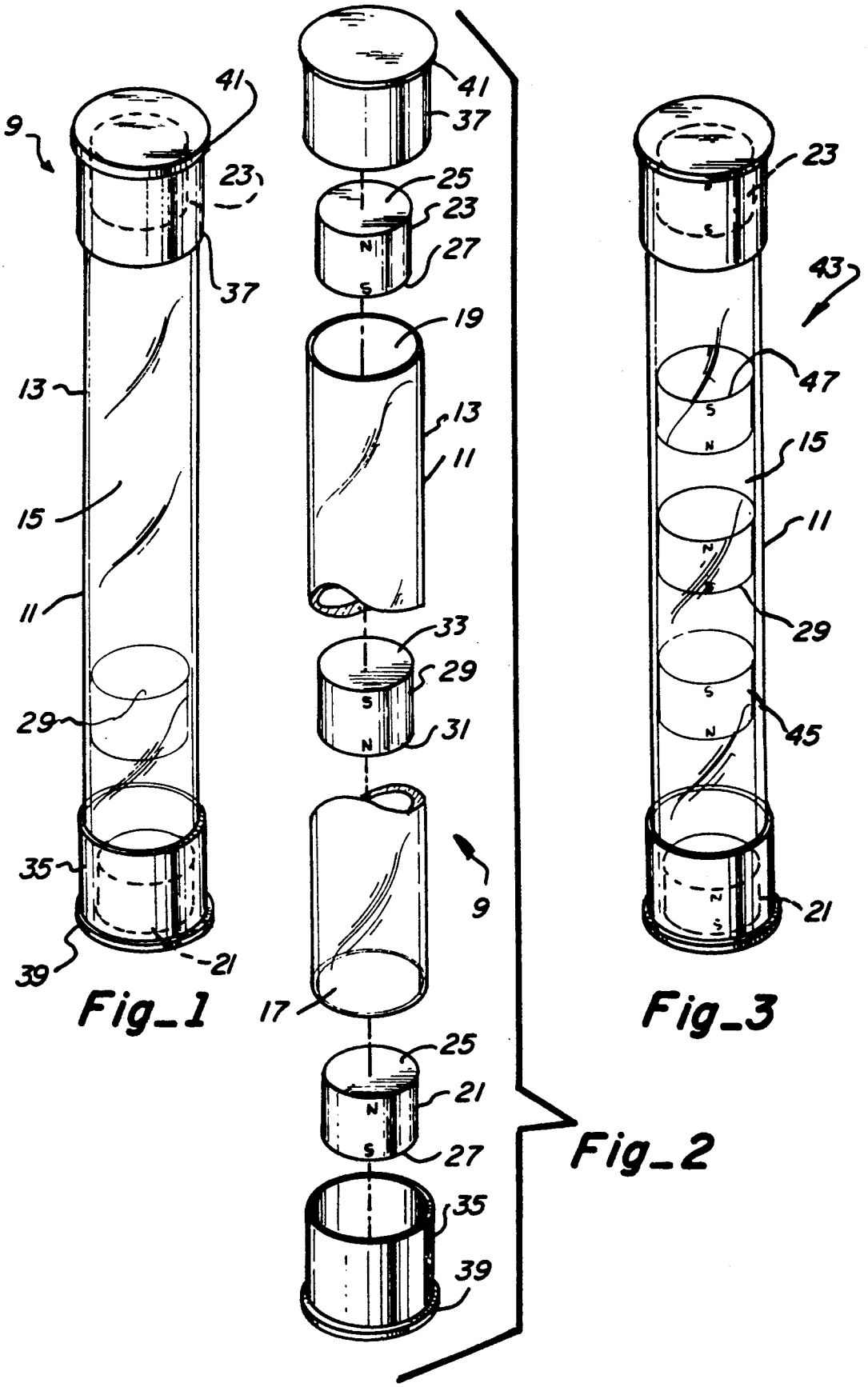
FIG. 1 is a perspective view of a first, and preferred, embodiment of the magnetic novelty item of this invention.
FIG. 2 is an exploded perspective view of the item of FIG. 1.
FIG. 3 is a perspective view of a second embodiment of the magnetic novelty item of this invention.

First, and preferred, embodiment 9 of the magnetic novelty item of this invention (an adult or children's toy, game piece or instructional aid) is illustrated in FIGS. 1 and 2. Novelty item 9 includes container 11, in this case a tubular container made of transparent material such as glass, acrylic, cellulose acetate butyrate, or other plastics. Container 11 includes side wall 13 defining elongated cavity 15 between open ends 17 and 19.

While a substantially rigid, and thus linear, clear sided, tubular container is preferred, other embodiments may have a container formed of opaque and/or flexible material, having a non-tubular cross section and/or a non-linear construction, and may be of varying lengths, diameters and/or cross sectional geometries.

Magnetic units 21 and 23, preferably permanent magnets (though electromagnets, with appropriate circuitry and power source, could be utilized), are secured in ends 17 and 19, respectively, utilizing, for example, glue, press fitting or the like. Magnets 21 and 23 may be permanently secured or removably secured so long as relatively stable in the container when in use. Each of magnets 21 and 23 has a north magnetic pole 25 and a south magnetic pole 27, preferably with the north pole of one and the south pole of the other positioned in container 11 facing cavity 15.

Magnetic unit 29, a permanent magnet having north magnetic pole 31 and south magnetic pole 33, has a cross section and/or length selected so that magnet 29 is movable, preferably slidably, in cavity 15 between ends 17 and 19, while yet maintaining orientation of its poles once within the container relative to magnets 21 and 23 (preferably with north magnetic pole 31 oriented toward north pole 25 of magnet 21 and with south magnetic pole 33 oriented toward south pole 27 of magnet 23 so that magnet 29 is repelled as it nears either of the others). Magnets 21, 23 and 29 may be covered with a colorful material, for example with paints, tape, decorations, characters, known fluorescent materials, or the like.

Each of the magnets may be of selected magnetic strength. For example, the novelty item of FIG. 1 has a container length of about six inches and an inside diameter of about five-eighths of an inch, and utilizes permanent magnets (ceramic disc magnets) having a field strength of about 3,800 Kilogauss (maximum energy product (BH) max of 3.40 MGO, and a Magnetic Materials Producer's Association rating of 5 for ceramic magnetics) for all three magnets. Magnets 21 and 23 have a diameter of about five-eighths of an inch while magnet 29 has a diameter of about nine-sixteenths of an inch, the magnets being about three-eighths to three-quarters of an inch long.

Container ends 17 and 19 are preferably capped with caps 35 and 37, respectively, (either permanently or removably), caps being formed of molded plastic material (such as low density polyethylene). Caps 35 and 37 may also be configured for various functions such as as bases, or, as shown in FIG. 1, with annular ridges 39 and 41 extending radially outward thus forming wheel-like structures.

FIG. 3 illustrates a second embodiment 43 of the magnetic novelty of this invention which is similar in most regards to embodiment 9 with the exception that additional magnetic units (permanent magnets) 45 and 47 are slidably received in cavity 15 of container 11 between secured magnets 21 and 23 and on either side of magnet 29. The magnetic poles of magnets 45 and 47 are preferably oriented toward like magnetic poles of the magnet on either side so that all magnets in the container are repelled by neighboring magnets. In this embodiment a longer, and/or more geometrically complex, container may be desirable.

Cavity 15 of container 11 of either embodiment may be filled (in some cases with container sealing required) with selected fluids such as air, neon or other gases or gas mixtures, water, oil or other liquids. When filled, for example, with neon gas or gas mixture, rapid movement of magnet 29 in cavity 15 could induce a glowing effect.

The novelty item of this invention has many uses ranging from use as an entertainment or plaything for children and/or adults (watching magnet 29 "bounce" or "float" in cavity 15 due to the repelling forces when the magnets are arranged as preferred, or, in pairs or other multiples, as a rolling toy, a "wand", building unit or the like), to (in pairs) a dexterity game or stress reliever in the nature of so-called worry beads. In multiples, the item can be used in various games such as keep away (each player having one of the items, with an additional item being variously manipulated by the players, for example toward or away from a goal). As an instructional aid, for example in schools, and particularly with all magnets being removable from the container for variable polar orientation thereof, the novelty item of this invention provides an entertaining yet educational tool for introducing a student to magnets and magnetism.

What is claimed is:

1. A magnetic novelty item comprising:

a container having first and second ends;

a first magnetic unit secured at said first end of said container;

a second magnetic unit secured at said second end of said container; and a third magnetic unit having a north pole and a south pole and received in said container in such a way that each of said poles remains substantially oriented toward, and in a repelling relationship with, a different one of said first and second magnetic units, said third magnetic unit being movable between said ends of said container.

2. The novelty item of claim 1 wherein said container is a substantially transparent tube.

3. The novelty item of claim 1 wherein said container defines a linear cavity between said ends having a length less than about one foot, said third magnetic unit being slidably received in said cavity.

4. The novelty item of claim 3 further comprising fourth and fifth magnetic units each having north and south poles and each slidably received in said cavity so that each of said magnetic units repels adjacent said magnetic units.

5. The novelty item of claim 1 wherein said container, said first and second magnetic units and said third magnetic unit are all of generally cylindrical configuration.

6. A magnetic toy comprising:

a container at least in part defining an elongated cavity between first and second open ends;

a first magnetic unit immovably secured in said first open end adjacent to said cavity of said container so that only one pole of said first magnetic unit has substantial influence within said cavity;

a second magnetic unit immovably secured in said second open end adjacent to said cavity so that only a pole thereof of opposite polarity to said one pole of said first unit has substantial influence within said cavity; and a third magnetic unit having first and second poles of opposite polarity and being slidably received in said cavity of said container in such a way that each of said poles thereof remains substantially oriented toward, and in a repelling relationship with, a different one of said first and second magnetic units.

7. The magnetic toy of claim 6 wherein at least said third magnetic unit is a permanent magnet.

8. The magnetic toy of claim 6 wherein at least a part of said container is made of substantially transparent material in the vicinity of said cavity.

9. The magnetic toy of claim 6 further comprising first and second capping means for capping said ends of said container.

10. The magnetic toy of claim 9 wherein said container is tubular in shape and substantially linear between said ends thereof, and wherein said capping means each include an annular ridge extending radially outward from said tubular container.

11. A magnetic toy comprising:

a tubular container having a side wall at least in part defining an elongated cavity visible through said side wall;

a first magnetic unit having a north magnetic pole and secured adjacent to said cavity so that said north pole faces into said cavity;

a second magnetic unit having a south magnetic pole and secured adjacent to said cavity so that said south pole faces into said cavity; and a cylindrical third magnetic unit having a north magnetic pole and a south magnetic pole and being slidably retained and oriented in said cavity by said side wall between said first and second magnetic units with said north pole of said third magnetic unit facing said north pole of said first magnetic unit and said south pole of said third magnetic unit facing said south pole of said second magnetic unit.

12. The magnetic toy of claim 11 wherein said cavity is filled with fluid.

13. The magnetic toy of claim 12 wherein said fluid is one of air, neon gas, water, oils, and mixtures thereof.

14. The magnetic toy of claim 11 further comprising a plurality of additional magnetic units having north and south poles slidably received in said cavity between said first and second magnetic units so that like poles of adjacent magnetic units face one another.

15. The magnetic toy of claim 11 wherein said container has first and second opposite ends, said side wall extending linearly between said ends.

16. The magnetic toy of claim 15 further comprising means for capping said ends.

17. The magnetic toy of claim 11 wherein at least said third magnetic unit is covered with a fluorescent material.

18. The magnetic toy of claim 11 wherein said tubular container is a substantially rigid, linear tube having a diameter of less than one inch.

19. The magnetic toy of claim 18 wherein said tubular container is about one foot or less in length.

* * * * *